United States Patent [19]

Machida

[11] Patent Number: 4,909,204

[45] Date of Patent: Mar. 20, 1990

[54] CONSTRUCTION OF TWO-CYCLE ENGINE LUBRICATING SYSTEM

[75] Inventor: Yutaka Machida, Saitama, Japan

[73] Assignee: Honda Giken Kogyo Kabushiki Kaisha, Tokyo, Japan

[21] Appl. No.: 298,374

[22] Filed: Jan. 18, 1989

[30] Foreign Application Priority Data

Jan. 18, 1988 [JP] Japan ..... 63-6944

[51] Int. Cl.[4] ..... F01M 1/00

[52] U.S. Cl. ..... 123/196 R; 123/74 R; 123/197 AC

[58] Field of Search ..... 123/196 R, 197 AC, 197 AB, 123/74 R; 180/230, 219

[56] References Cited

U.S. PATENT DOCUMENTS

| | | | |
|---|---|---|---|
| 3,204,619 | 9/1965 | Rubinowitz et al. | 123/196 R |
| 4,498,553 | 2/1985 | Kurata et al. | 180/230 |
| 4,723,619 | 2/1988 | Yamamoto et al. | 180/219 |
| 4,745,817 | 5/1988 | Tomita et al. | 123/197 AB |

*Primary Examiner*—E. Rollins Cross

*Attorney, Agent, or Firm*—Lyon & Lyon

[57] ABSTRACT

In a two-cycle engine lubrication system in which a crankshaft is supported on a pair of bearings in a crankcase, the crankshaft being sealed with seals mounted outwardly of the bearings and lubricating holes being provided along transfer passages which connect the crankcase with a combustion chamber and extending into the crankshaft bore between the bearings and the seals. The lubricating holes open into the crankshaft bore close to the bearing and one or more lubricant guide grooves extend outwardly in the crankshaft bore from the lubricating holes to a seal.

12 Claims, 2 Drawing Sheets

CONSTRUCTION OF TWO-CYCLE ENGINE LUBRICATING SYSTEM

BACKGROUND OF THE INVENTION

The field of the present invention is lubrication of two-cycle engines and specifically distribution of lubricant in two-cycle engines.

Conventional two-cycle engines employing lubricant entrained in the air-fuel mixture typically may employ a lubricating system such as illustrated in FIG. 6. The engine includes a crankcase 1, a cylinder 2, a piston 3, a connecting rod 4 and a crankshaft 5. The crankcase 1 and the interior of the cylinder 2 are connected by transfer passages 6 and 7. The crankshaft 5 is supported on a pair of bearings 8 and 9 in the crankcase 1. The bearings are in turn mounted in the crankshaft bore having sections 10 and 11.

In operation, entrained lubricant tends to adhere to the walls of the transfer passages and migrate downwardly toward the crankshaft. Such droplets of lubricant are represented in the transfer passages 6 and 7 at A. Lubricating holes 14 and 15 are provided strategically on the lower wall of the transfer passages 6 and 7 to collect and transport the lubricant into the shaft bore sections 10 and 11. The bearings 8 and 9 are adjacent the lubricating holes 14 and 15 to receive the lubricant passing therethrough. The lubricant also runs into the expanded portions 10*a* and 11*a* of the crankshaft bore sections to flow along the surface of the crankshaft 5 to appropriately wet the seals 12 and 13 located outwardly of the bearings 8 and 9.

The crankshaft 5 may also include a gear 16 formed on one side of the crankshaft to drive an oil pump through driving gear 17. This displaces the seal 12 laterally away from the bearing 8.

In such a conventional engine as is depicted in FIG. 6, pressure changes repeatedly occur within the crankcase 1 to enhance the flow of lubricant along the lubricating holes 14 and 15 and into the bearings 8 and 9. However, the conditions do not positively direct lubricant outwardly at the same time to the seals 12 and 13. This is particularly true if there is a substantial distance to the seals from the lubricating holes. This condition is aggravated by the presence of a lubricant consuming mechanism such as the gears 16 and 17 located between the seal 12 and the lubricant supply. This condition can lead to accelerated wear of the seals.

SUMMARY OF THE INVENTION

The present invention is directed to a mechanism and/or structure for advantageously distributing lubricant in the crankshaft bore of a two-cycle engine. One or more grooves extend along the crankshaft bore to direct lubricant outwardly on the crankshaft. Accordingly, it is an object of the present invention to provide improved lubrication in two-cycle engines. Other and further objects and advantages will appear hereinafter.

DETAILED DESCRIPTION OF THE PREFERRED EMBODIMENT

Figure 3:
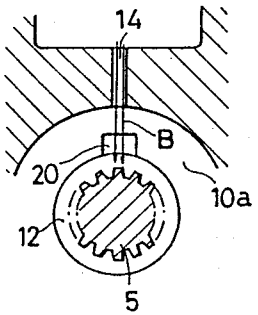
FIG. 3 is a cross-sectional view taken along line III—III of FIG. 2.
Figure 2:
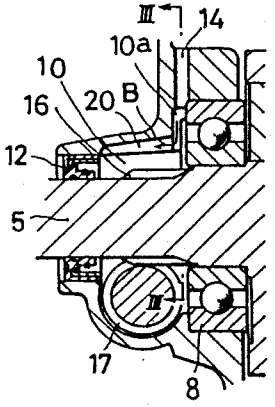
FIG. 2 is a cross-sectional front view illustrating a detail of FIG. 1.
Figure 1:
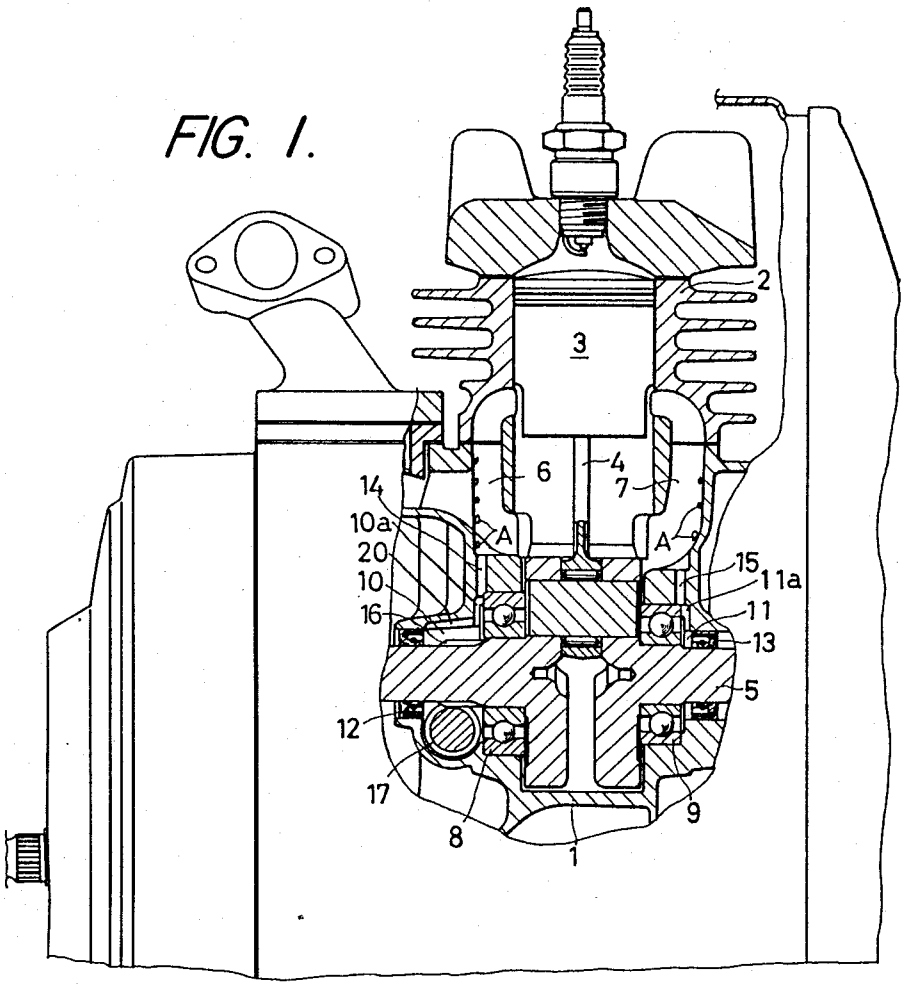
FIG. 1 is a front view shown in partial cross section of an engine incorporating the present invention.
Figure 6:
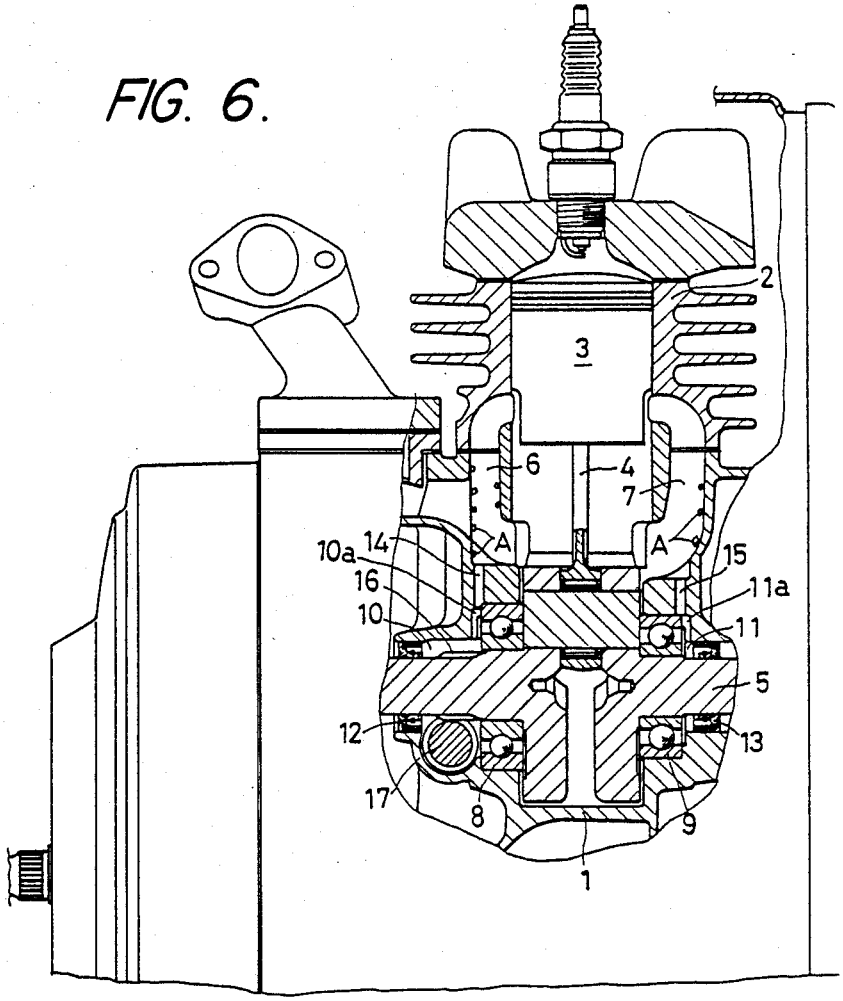
FIG. 6 is a front view of a conventional engine with portions in cross section as in FIG. 1.

FIGS. 1 to 3 illustrate a first embodiment of the present invention. In FIG. 1, the same reference numerals are employed to identify the same parts as appear in FIG. 6. Their conventional nature makes unnecessary a repetition of the identity of these parts.

In the embodiment of FIGS. 1 2 and 3, an lubricant guide groove 20 is located on the upper surface of the shaft bore portion 10. This lubricant guide groove 20 is open downwardly along its length, extends laterally outwardly from the lubricating hole 14 in a direction away from the centerline of the cylinder and is angled downwardly toward the crankshaft 5. In this way, the groove 20 receives a portion of the lubricant from the lubricating hole 14 and, by the natural wetting action of the lubricant on the body of the engine, flows outwardly and slightly downwardly to arrive at the seal 12.

By this construction, the lubricating hole 14 is located such that it is adjacent the bearing 8 to insure that a flow of lubricant is provided to the bearing. The remaining portion of the lubricant flows from the expanded portion 10*a* of the bore section 10 into the lubricant guide groove 20 as indicated by the arrow B in FIG. 2. Through its viscosity and wetting properties, the lubricant flows along the top and side surfaces of the groove 20. Thus, one portion of the lubricant flow is directly downwardly along the inner peripheral surface of the shaft bore 10 to lubricate the bearing 8 while the remaining portion flows outwardly to the seal 12. This location of the lubricating holes may be changed to a certain extend without affecting the overall operation of the system.

Figure 5:
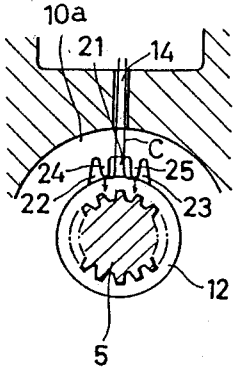
FIG. 5 is a cross-sectional view taken along line V—V of FIG. 4.
Figure 4:
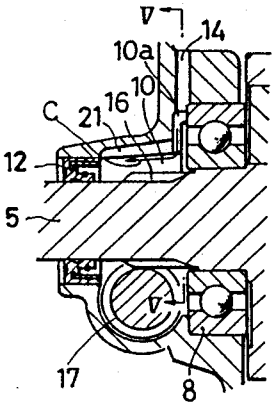
FIG. 4 is a view similar to that of FIG. 2 showing a second embodiment.

Looking next to the embodiment of FIGS. 4 and 5, a downwardly slanting lubricant groove 21 is provided in a similar fashion to that of groove 20 in the first embodiment. The groove 21 extends from the lubricating hole 14 to the seal 12. To either side of the lubricant guide groove 21 are mutually adjacent and substantially coextensive grooves 22 and 23. The grooves 22 and 23 cooperate with the groove 21 to form a pair of ribs 24 and 25 t either side of the groove 21.

The lubricant flows along the lubricant guide groove 21 toward the seal 12 as indicated by the arrow C. Again, a part of the lubricant flow is along the inner surface of the shaft bore portion 10. This flow is to a certain extend checked by the grooves 22 and 23 such that these grooves further accumulate lubricant clinging to the lower edges of the ribs 24 and 25 to reach the seal 12. The side grooves 22 and 23 may be either parallel or slightly divergent as may best suit lubricant flow characteristics of a particular engine.

Accordingly, an improved lubricant system is provided which enhances the flow of lubricant outwardly along the crankshaft. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A two-cycle engine comprising a cylinder;

a crankcase;

a transfer passage extending between said crankcase and said cylinder;

a crankshaft bore in said crankcase;

a crankshaft in said bore;

a lubricating hole extending between said transfer passage and said bore;

a groove in said bore extending laterally and toward said crankshaft from said lubricating hole.

2. The two-cycle engine of claim 1 further comprising a plurality of said grooves.

3. The two-cycle engine of claim 2 wherein said grooves are mutually adjacent and substantially coextensive.

4. The two-cycle engine of claim 1 further comprising two bearings to either side of said cylinder in said crankcase rotatably mounting on said crankshaft in said bore; and seals positioned outwardly and displaced from said bearings on said crankshaft, said lubricating hole extending to adjacent one said bearing in said bore, said groove extending from said lubricating hole to adjacent one of said seals.

5. The two-cycle engine of claim 4 further comprising a gear on said crankshaft between said bearing and said seal between which said groove extends.

6. The two-cycle engine of claim 1 wherein said groove opens downwardly along its length.

7. A lubricating system for a two-cycle engine having a cylinder, a crankcase, a transfer passage extending between said crankcase and said cylinder, a crankshaft bore in said crankcase, and a crankshaft in said bore, comprising a lubricating hole extending between said transfer passage and said bore;

a groove extending in said bore laterally and downwardly from said lubricating hole.

8. The lubricating system of claim 7 further comprising a plurality of said grooves.

9. The lubricating system of claim 8 wherein said grooves are mutually adjacent and substantially coextensive.

10. The lubricating system of claim 7 wherein the engine includes bearings rotatably mounting the crankshaft in the crankshaft bore and seals in the bore about the crankshaft outwardly of the bearings, said lubricating hole being adjacent one of the bearings and said groove extending from said lubricating hole to one of the seals.

11. The lubricating system of claim 10 wherein the engine further includes a gear on the crankshaft between one of the bearings and one of the seals, said groove spanning the gear from said lubricating hole adjacent the bearing to the seal.

12. The lubricating system of claim 7 wherein said groove is open downwardly along its length.

* * * * *